US010611000B1

(12) United States Patent
Foster

(10) Patent No.: US 10,611,000 B1
(45) Date of Patent: Apr. 7, 2020

(54) FLEXIBLE SANDING BLOCK USING HOOK AND LOOP FASTENER

(71) Applicant: Thomas E. Foster, Austin, TX (US)

(72) Inventor: Thomas E. Foster, Austin, TX (US)

( * ) Notice: Subject to any disclaimer, the term of this patent is extended or adjusted under 35 U.S.C. 154(b) by 0 days.

(21) Appl. No.: 16/599,558

(22) Filed: Oct. 11, 2019

Related U.S. Application Data

(60) Provisional application No. 62/834,643, filed on Apr. 16, 2019.

(51) Int. Cl.
*B24D 15/00* (2006.01)
*B24D 15/04* (2006.01)

(52) U.S. Cl.
CPC ..... *B24D 15/04* (2013.01)

(58) Field of Classification Search
CPC .... B24D 15/04; B24D 15/00; B24D 18/0036; B24D 18/0045; B24D 9/085; B24B 37/22; B24B 55/10
USPC .... 451/523, 526–539, 344–359; 83/879–887
See application file for complete search history.

(56) References Cited

U.S. PATENT DOCUMENTS 2,446,183 A * 8/1948 Larson ..... B24D 15/04 451/503
5,170,595 A * 12/1992 Wiand ..... B24D 9/085 15/230
5,201,149 A * 4/1993 Eisenblatter ..... B24D 9/085 15/230.17
5,201,785 A * 4/1993 Nagano ..... A47L 11/164 451/508
5,454,751 A * 10/1995 Wiand ..... B24D 7/06 451/353
5,558,572 A * 9/1996 Fletcher ..... B24D 15/06 451/490
5,662,519 A * 9/1997 Arnold ..... B24D 15/04 451/525
5,775,984 A * 7/1998 Olson ..... B24D 9/085 451/532
5,944,586 A * 8/1999 Sevigny ..... B24D 7/04 451/359
6,042,462 A * 3/2000 Baratti ..... B24D 3/34 451/533
6,045,887 A * 4/2000 Martin ..... B24B 23/04 428/100
6,227,959 B1 * 5/2001 Beaudry ..... B24D 15/023 451/490
7,396,276 B2 * 7/2008 Ali ..... B24D 15/04 451/354
8,834,235 B1 * 9/2014 Foster ..... B24D 15/04 451/344
2006/0236840 A1 * 10/2006 McGlinchy ..... B24B 7/075 83/879

(Continued)

*Primary Examiner* — George B Nguyen
(74) *Attorney, Agent, or Firm* — Kowert, Hood, Munyon, Rankin & Goetzel, P.C.

(57) ABSTRACT

A flexible sanding apparatus that utilizes a hook-and-loop fastener for attaching sandpaper to an elastomeric body is described. The sanding apparatus may include an elastomeric body with a thin, relatively flat spring member attached to a bottom surface of the elastomeric body. A first component of the hook-and-loop fastener may be coupled to the elastomeric body while being positioned in a recessed portion on the bottom surface of the elastomeric body. A second component of the hook-and-loop fastener with a sanding surface may be attached to the first component.

20 Claims, 5 Drawing Sheets

(56) References Cited

U.S. PATENT DOCUMENTS

| | | | | |
|---|---|---|---|---|
| 2007/0054609 | A1* | 3/2007 | Hackett | B24B 7/182<br>451/523 |
| 2009/0191376 | A1* | 7/2009 | Rivard | B24B 45/006<br>428/100 |
| 2010/0112920 | A1* | 5/2010 | Usui | B24D 11/00<br>451/539 |
| 2010/0154614 | A1* | 6/2010 | Liao | B26D 7/086<br>83/880 |
| 2012/0006175 | A1* | 1/2012 | Bando | B26D 3/085<br>83/880 |
| 2015/0087213 | A1* | 3/2015 | Owens | E04F 21/0069<br>451/523 |
| 2015/0283677 | A1* | 10/2015 | Karppinen | B24D 15/04<br>451/523 |

* cited by examiner

FLEXIBLE SANDING BLOCK USING HOOK AND LOOP FASTENER

PRIORITY CLAIM

This patent claims priority to U.S. Provisional Patent Application No. 62/834,643 to Foster, entitled "FLEXIBLE SANDING BLOCK USING HOOK AND LOOP FASTENER", filed Apr. 16, 2019, which is incorporated by reference in its entirety.

BACKGROUND

1. Field of the Invention

Embodiments disclosed herein relate to a flexible contour sander. Certain embodiments disclosed herein relate to a flexible contour sander with a hook-and-loop fastener for attaching a sanding surface where the sander is for use on single or compound curved surfaces and also can be used to flatten surfaces.

2. Description of Related Art

One of the more common uses of contour sanders is repairing automobile body panels. Automobile body panels are typically made of light-weight metals, fiberglass, or plastic materials that are relatively thin. The panels are shaped into contoured (curved) body lines to provide strength and aerodynamic features for the body panels. The contoured body lines may include convex or concave curves, scooped areas, and/or channels. The sanders used on the body panels may have an adjustable curvature to allow the sander to conform to different shaped body panels and allow the sander to be used on multiple body panels and/or automobiles. The curvature of the sander may be adjusted to conform to the curvature of a specific body panel to provide accurate sanding on the body panel surface (e.g., sanding of the body panel to return the body panel as close to its original shape as possible).

Velcro (e.g., hook-and-loop fasteners) are commonly used as attachment means for both rigid manual and power flat disc or reciprocating sanders. Hook-and-loop fasteners may be advantageous over "stick-on" (adhesive) types of sandpapers as the hook-and-loop fastener can be used to put on and take off sandpaper multiple times without the sandpaper losing the ability to stay attached to the surface of the sander body. For example, "stick-on" sandpapers may lose their ability to stay attached when dust sticks to the adhesive or some of the adhesive stays on the sander body when removed.

When hook-and-loop fasteners are used with flexible sanding blocks, however, the sandpaper may bunch up or pull loose when the block is flexed. For example, when a typical foam rubber sanding block is flexed, the centerline of the block does not change in length but either the top or the bottom side of the block must stretch while the opposite side must compress. Thus, the further the sandpaper is from the centerline, the more the sandpaper is likely to bunch up or pull loose when the sanding block is flexed. Additionally, the thicker the sanding block, the more the top and bottom must stretch or compress, increasing the amount of bunching or loosening of the sandpaper. The buckling (e.g., bunching) or pulling loose may occur because the hook-and-loop fastener is bendable but cannot stretch or compress lengthwise In some cases, bonding a thin base member of, for example, spring steel or another material that resists compression or stretching to a flexible sanding block (e.g., a rubber material that can stretch or compress) may be useful because the centerline (where the length of the block does not change when the block is flexed) becomes the middle of the thin base member. Because the thin base cannot compress or stretch, all of the compressing or stretching is done in the flexible part of the block. However, when one side of a hook-and-loop fastener (e.g., the hook side) is added to the thin base member, the side of the hook-and-loop fastener adds distance from the centerline and adds to the amount of stretch or compression that occurs at the surface of the hook-and-loop fastener when the sanding block is flexed. Even more distance is added when the other side of the hook-and-loop fastener (e.g., the loop side) is added and even more stretch and compression occurs. This side of the hook-and-loop fastener may also be used to attach the sandpaper to the sanding block. Thus, the distance from the centerline added by both sides of the hook-and-loop fastener may increase stretching and/or compression of the sandpaper, which may likely lead to buckling or pulling loose of the sandpaper. Thus, there is a need for a sander that implements a hook-and-loop fastener without causing buckling or pulling loose of sandpaper attached to a flexible sanding block by the hook-and-loop fastener.

SUMMARY

In certain embodiments, a sanding apparatus includes an elastomeric body having a bottom surface, at least one thin, relatively flat spring member attached to the bottom surface of the elastomeric body, and at least one first component of a hook-and-loop fastener coupled to the bottom surface of the elastomeric body. The at least one first component of the hook-and-loop fastener may be positioned in a recess on the bottom surface of the elastomeric body. The at least one thin, relatively flat spring member and the at least one first component of the hook-and-loop fastener may be positioned such that the outer surface of each is in approximately the same plane to form a relatively flat surface on the bottom surface of the elastomeric body for at least one second component of the hook-and-loop fastener to attach thereto.

In certain embodiments, a sanding apparatus includes an elastomeric body having a bottom surface, a first thin, relatively flat spring member attached to the bottom surface of the elastomeric body, a second thin, relatively flat spring member positioned in a recess on the bottom surface of the elastomeric body and attached to the bottom surface of the elastomeric body in the recess, and at least one first component of a hook-and-loop fastener attached to the second flat spring member in the recess. The first thin, relatively flat spring member and the at least one first component of the hook-and-loop fastener may be positioned such that the outer surface of each is in approximately the same plane to form a relatively flat surface on the bottom surface of the elastomeric body for at least one second component of the hook-and-loop fastener to attach thereto.

BRIEF DESCRIPTION OF THE DRAWINGS

Features and advantages of the methods and apparatus described herein will be more fully appreciated by reference to the following detailed description of presently preferred but nonetheless illustrative embodiments when taken in conjunction with the accompanying drawings in which.

Figure 1:
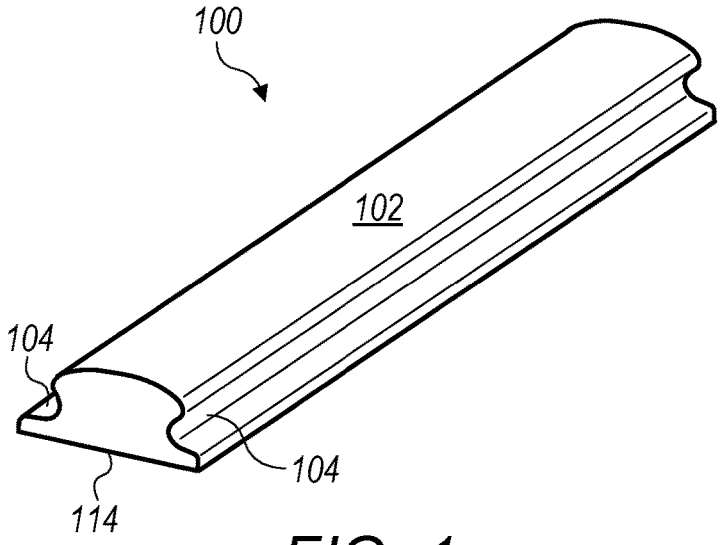
FIG. 1 depicts a perspective view of an embodiment of a sander.

While the disclosure is susceptible to various modifications and alternative forms, specific embodiments thereof are shown by way of example in the drawings and will herein be described in detail. It should be understood, however, that the drawings and detailed description thereto are not intended to limit the disclosure to the particular form illustrated, but on the contrary, the intention is to cover all modifications, equivalents and alternatives falling within the spirit and scope of the present disclosure as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include," "including," and "includes" mean including, but not limited to. Additionally, as used in this specification and the appended claims, the singular forms "a", "an", and "the" include singular and plural referents unless the content clearly dictates otherwise. The term "include," and derivations thereof, mean "including, but not limited to".

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

The following examples are included to demonstrate preferred embodiments. It should be appreciated by those of skill in the art that the techniques disclosed in the examples which follow represent techniques discovered by the inventor to function well in the practice of the disclosed embodiments, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the disclosed embodiments.

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

In the context of this patent, the term "coupled" means either a direct connection or an indirect connection (e.g., one or more intervening connections) between one or more objects or components. The phrases "attached" and "directly connected" mean a direct connection between objects or components such that the objects or components are connected directly to each other so that the objects or components operate in a "point of use" manner.

In the context of this patent, the term "automobile" refers to any type of motor vehicle such as a car, truck, or SUV. It is to be understood that while reference is made to the use of the sanding (e.g., "sander") on surfaces of an automobile that the sanding apparatus may be used in many other instances. For example, the sander may be used on single or compound curved surfaces and may also be used to flatten surfaces. The sander may be used on any surface that can be sanded to smooth out imperfections or to create smooth contours. Examples of surfaces included, but are not limited to, automobile bodies, boats, furniture, stone art work, metal, plaster, fiberglass, and wood. In some instances, the sander may be used in homes for trim, sheetrock, arches, columns, and/or general paint preparation.

FIG. 1 depicts a perspective view of an embodiment of sander 100. Sander 100 may be used, for example, for sanding surfaces of an automobile on surfaces of the automobile. In certain embodiments, sander 100 includes elastomeric body 102 (e.g., an elastomeric member). Elastomeric body 102 may be made of material that can compress or stretch (e.g., flexible material). For example, elastomeric body 102 may be a rubber member, a foam rubber member, or another member made of flexible or elastomeric material. In some embodiments, elastomeric body 102 is a flexible urethane block or a flexible urethane foam block. In some embodiments, elastomeric body 102 includes contours 104. Contours 104 may allow a user to grasp and use elastomeric body 102. Sanding surface 114 may be positioned on a bottom of sander 100 and used to contact a surface for sanding, as described herein.

Figure 2:
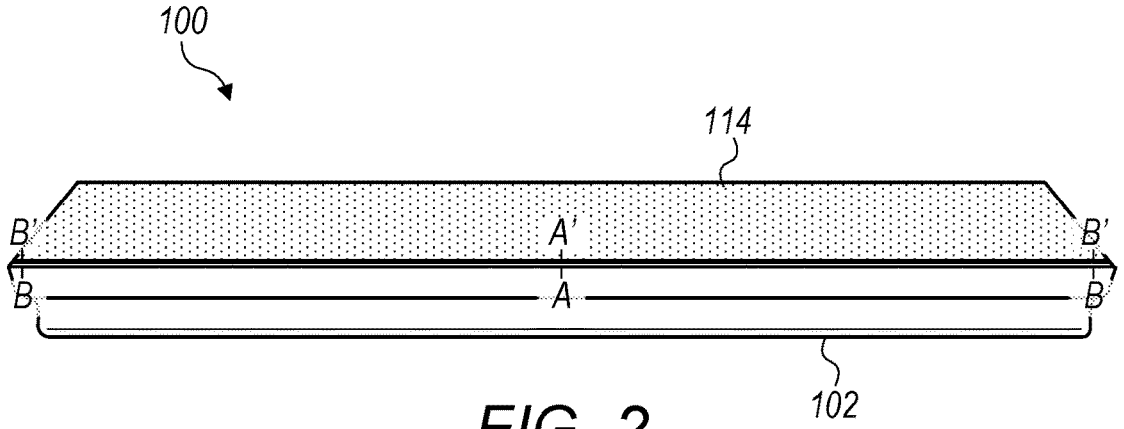
FIG. 2 depicts a representation of an embodiment of a sander in a flat position.
Figure 3:
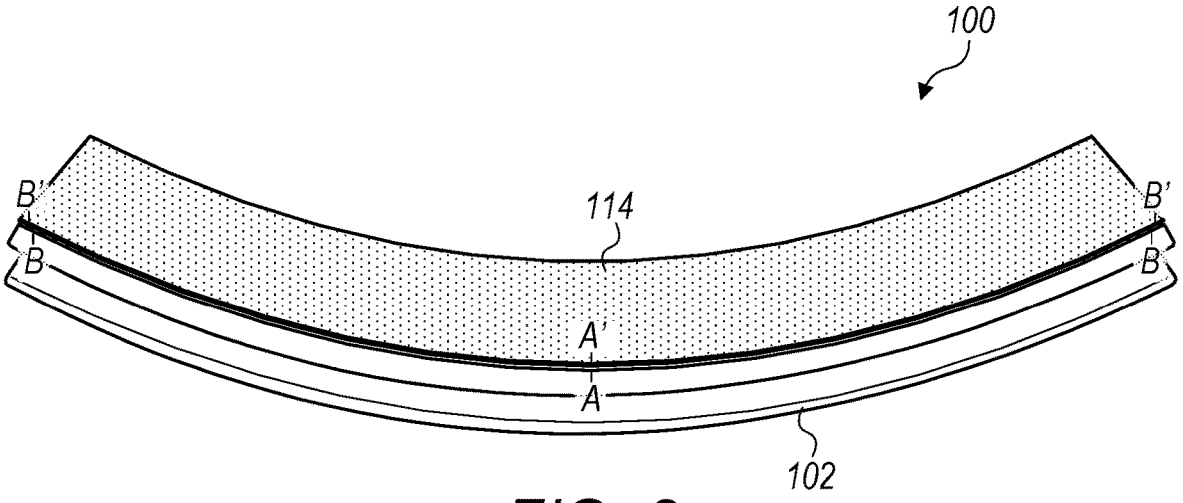
FIG. 3 depicts a representation of an embodiment of a sander being flexed concavely.
Figure 4:
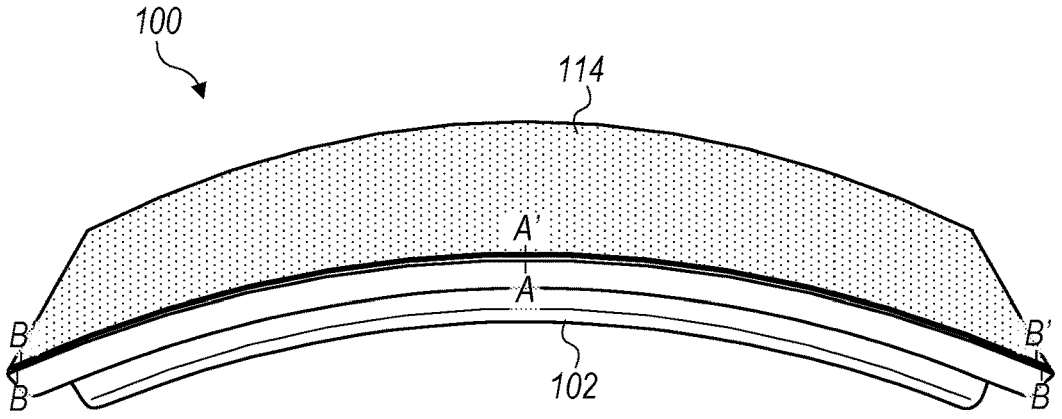
FIG. 4 depicts a representation of an embodiment of a sander being flexed convexly.

As sander 100 includes elastomeric body 102, sander 100 may be flexed as needed to provide a desired shape for sanding a surface with sanding surface 114. FIG. 2 depicts a representation of an embodiment of sander 100 in a flat position with sanding surface 114 coupled to elastomeric body 102 (using, for example, components 110 and 112 as described herein). In some embodiments, sander 100 may be flexed to be used on a convex surface. FIG. 3 depicts a representation of an embodiment of sander 100 being flexed concavely such that sanding surface 114 may substantially match a convex surface to be sanded. In some embodiments, sander 100 may be flexed to be used on a concave surface. FIG. 4 depicts a representation of an embodiment of sander 100 being flexed convexly to substantially match a concave surface to be sanded. In some embodiments, sander 100 is grasped by a user using contours 104 and flexed to the desired shape.

Figure 5:
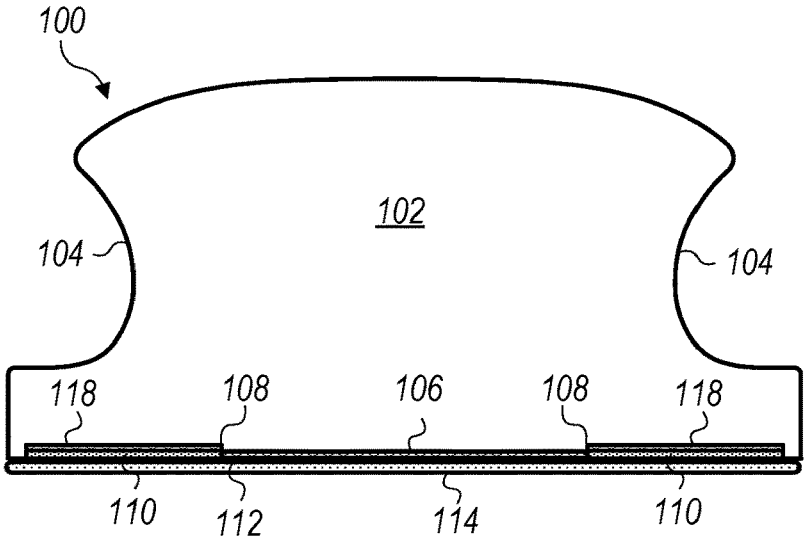
FIG. 5 depicts a cross-sectional representation of an embodiment of a sander.

FIG. 5 depicts a cross-sectional representation of an embodiment of sander 100. In certain embodiments, base member 106 is attached or bonded to elastomeric body 102. Base member 106 may, for example, be attached to a portion (e.g., a flat bottom portion or relatively flat bottom portion) of the bottom surface of elastomeric body 102, as shown in FIG. 5. In certain embodiments, base member 106 is an elongated thin, relatively flat piece of strong, flexible material such as, but not limited to, steel (e.g., stainless steel), carbon fiber, or fiberglass. Base member 106 may be, for example, a flat spring member made of steel, carbon, fiber, or fiberglass. In certain embodiments, base member 106 has a thickness between about 0.015" and about 0.020". In some embodiments, base member 106 have a thickness between about 0.010" and about 0.040". Base member 106 may be a spring-like member that resists compression or stretching while being flexible. In certain embodiments, elastomeric body 102 is formed or molded (e.g., using an injection or poured molding process) around base member 106.

In certain embodiments, elastomeric body 102 includes recessed portions 108 (e.g., recesses in the bottom surface of the elastomeric body). Recessed portions 108 may be formed as cutouts or other cavities in elastomeric body 102 (e.g., during the injection or poured molding process). In certain embodiments, recessed portions 108 are positioned alongside base member 106 on the bottom surface of elastomeric body 102.

In some embodiments, when sander 100 is flexed over a convex surface (e.g., the sander is flexed as shown in FIG. 3), an arc formed by base member 106 may have a smaller radius than an arc formed by the surface of recessed portions 108. During this flexing, since base member 106 is a non-compressible member, the centerline of the base member may not change in length while the lower side of the base member compresses a small amount and the upper side of the base member stretches a small amount for the base member to bend. At the same time, elastomeric body 102 must also stretch because the body is connected to the outside of base member 106 (e.g., the non-compressible member). Thus, the surfaces of recessed portions 108 may have a larger arc than base member 106 and will not bend as far as the base member. If the two arcs (arc of base member 106 and arc of surfaces of recessed portions 108) have close to the same radii, then the arc for the surfaces of recessed portions 108 may be affected by base member 106. The surfaces of recessed portions 108 may also be affected by base member 106 if the recessed portions are adjacent to the base member.

In certain embodiments, sander 100 includes stabilizing members 118 positioned in recessed portions 108, as shown in FIG. 5. Stabilizing members 118 may be used to reduce or inhibit the effects of base member 106 on the surfaces of recessed portions 108. For example, stabilizing members may ensure that the surfaces of the recessed portions 108 have only a small difference in length when elastomeric body 102 is flexed in either direction. Stabilizing members 118 may be attached or bonded to a surface of elastomeric body 102 in recessed portions 108 (e.g., the surfaces of the recessed portions). For example, stabilizing members 118 may be attached to a portion (e.g., a flat bottom portion or relatively flat bottom portion) of the bottom surface of elastomeric body 102 in recessed portions 108. Stabilizing members 118 may have similar properties to base member 106. For example, stabilizing members 118 may be elongated thin, relatively flat pieces of strong, flexible material such as, but not limited to, steel (e.g., stainless steel), carbon fiber, or fiberglass. In some embodiments, stabilizing members 118 are flat spring members made of steel, carbon, fiber, or fiberglass. In certain embodiments, stabilizing members 118 have thickness on the order of base member 106 (e.g., thicknesses between about 0.015" and about 0.020" or between about 0.010" and about 0.040"). Stabilizing members 118 may resist compression or stretching (e.g., be non-compressible) while being flexible. In certain embodiments, elastomeric body 102 is formed or molded (e.g., using an injection or poured molding process) around stabilizing members 118 in addition to base member 106.

Figure 6:
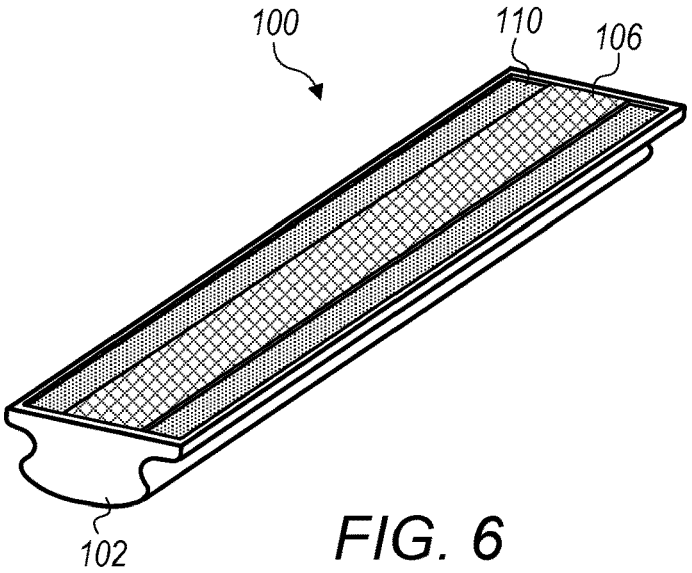
FIG. 6 depicts a bottom-view perspective representation showing relative positions of base members and components in the embodiment of the sander depicted in FIG. 5.

In certain embodiments, first hook-and-loop components 110 are positioned in recessed portions 108. Components 110 may be coupled to (e.g., attached to) stabilizing members 118. Components 110 may be, for example, hook components of a hook-and-loop fastener (e.g., a Velcro fastener). FIG. 6 depicts a bottom-view perspective representation showing relative positions of base members 106 and components 110 (attached to stabilizing members 118) in the embodiment of sander 100 depicted in FIG. 5 without component 112 and sanding surface 114 coupled to components 110. In the embodiment depicted in FIGS. 5 and 6, base member 106 is a rectangular-shaped base member with components 110 positioned on opposing sides of base member 106, where components 110 are attached to stabilizing members 118.

In certain embodiments, components 110 are strips that are attached to stabilizing members 118 and have a similar length as base member 106. In some embodiments, components 110 are made up of several components attached to stabilizing members 118 and positioned on opposite sides of base member 106. For example, components 110 may include multiple strips of hook components attached to stabilizing members 118. Components 110 may be attached to stabilizing members 118 using an adhesive. For example, components 110 may include adhesive surfaces that attach the components to stabilizing members 118. The depths of recessed portions 108 along with the thicknesses of base member 106 and stabilizing members 118 may be selected such that when components 110 are attached to stabilizing members 118, which are positioned in recessed portions 108, components 110 and base member 106 may provide a relatively flat surface to support and retain a sanding surface (e.g., sanding surface 114 described herein).

In certain embodiments, as shown in FIG. 5, component 112 is coupled to (e.g., attached or fastened to) component(s) 110. Component 112 may be a second hook-and-loop component that is paired with component(s) 110. For example, component 112 may be a loop component of a hook-and-loop fastener that couples to component(s) 110 when component(s) 110 is a hook component. While embodiments disclosed herein describe component 110 as the hook component of a hook-and-loop fastener and component 112 as the loop component of the hook-and-loop fastener, it is to be understood that these components can be switched any of the embodiments disclosed (e.g., component 112 is the hook component and component 110 is the loop component). Attaching component 112 to component(s) 110 may place component 112 close to or in contact with the surface(s) of base member(s) 106.

In certain embodiments, as shown in FIG. 5, sanding surface 114 is attached to component 112. Sanding surface 114 may be, for example, a thin piece of sandpaper or another abrasive material coupled to component 112. Sanding surface 114 may be coupled to component 112 using an adhesive or other fastening material. For example, component 112 may have an adhesive surface for coupling to sanding surface 114. In some instances, sandpaper (e.g., sanding surface 114) that is pre-attached to a hook-and-look component may be used. For example, sandpaper attached to the loop side of Velcro is commercially available for flat sanding blocks (such as in strips that are 2¾" wide×16" long or in 2¾" wide rolls) and may be used for some embodiments of sander 100. Sanding surface 114 may be used to sand the surface of the automobile or another surface while elastomeric body 102, base members 106, stabilizing members 118, and components 110 provide support for the sanding surface.

In certain embodiments, as described above, the depths of recessed portions 108 and the thicknesses of base member 106 and stabilizing members 118 are selected to provide a relatively flat support surface and allow sanding surface 114 to have substantially the same height above base members 106 and components 110 when components 110 are coupled to component 112. For example, portions of sanding surface 114 backed with component 112 over base members 106 may have the same height as portions of sanding surface 114 backed with component 112 over components 110 in recessed portions 108 when components 110 and component 112 are coupled together. In some embodiments, the depths of recessed portions 108 above stabilizing members 118 (e.g., the depths of the recessed portions minus the thicknesses of the stabilizing members) are selected to be substantially equivalent to a thickness of components 110 plus the difference in the sum of the thickness of components 110 and component 112 when the components are measured individually minus the thickness of components 110 and component 112 when the components are attached together. As such, when components 110 are attached to stabilizing members 118 in recessed portions 108 and components 110 and component 112 are coupled together, sanding surface 114 may have substantially the same height above the base members 106 and components 110 in the recessed portions after components 110 and component 112 are pressed together.

In the embodiment of sander 100 depicted in FIGS. 5 and 6, stabilizing members 118 may be non-compressible members placed under components 110 to inhibit distortion of recessed portions 108 of elastomeric body 102 (which is compressible) by base member 106 (which is non-compressible). Inhibiting distortion of recessed portions 108 may allow the arc of the recessed portions and the arc of base member 106 (described above) to say approximately the same distance apart as the recessed portions and base member 106 are flexed in either direction. Thus, when sander 100 is flexed over a concave surface, as shown in FIG. 4, base member 106 may have an arc with a larger radius than an arc of recessed portions 108 but the distance between the two arcs may remain substantially the same and components 110 may hold sanding surface 114 (and component 112) against base member 106. Thus, having stabilizing members 118 in recessed portions 108 may be useful when the two arcs (e.g., arc of base member 106 and arc of surfaces of recessed portions 108) have close to the same radii and/or where the planes of base members 106 and recessed portions 108 are adjacent to each other. For example, the addition of stabilizing members 118 in recessed portions 108 may force the surfaces of the recessed portions to be controlled by the centerline of stabilizing members 118 (the non-compressible members) and stabilizing members 118 on opposite sides of base member 106 may force any stretching or compressing of elastomeric body 102 to occur between stabilizing members 118 and base member 106.

In certain embodiments, with sander 100 in a flat position, as shown in FIG. 2, the plane of base member 106 and the plane of the surfaces of recessed portions 108 are parallel to each other. When sander 100 is flexed in either direction, as shown in FIGS. 3 and 4, the arcs formed by base member 106 and the surfaces of recessed portions 108 may remain substantially the same distance apart due to the presence of stabilizing members 118. As such, sanding surface 114 may be held by component 110 to be in contact with base member 106 in all positions as sander 100 is flexed in either direction. Sanding surface 114 may slide in relation to base member 106 because the sanding surface is only held in place by component 110, which is coupled to the surfaces of recessed portions 108 via stabilizing members 118.

Thus, when sander 100 is flexed over a convex surface (e.g., flexed as shown in FIG. 3) the ends of sanding surface 114 may be allowed to slide away from the center of base member 106 in order to keep the sanding surface from bunching up on the surface of the base member. This movement of sanding surface is shown by the relative positions of points A' and B' on sanding surface 114 and points A and B on elastomeric body 102 in FIG. 3 versus the original positions of these points when sander 100 is flat, as shown in FIG. 2. For example, the center points A/A' remain in alignment while points B' on sanding surface 114 move closer to the edges (towards edges from points B) during the flexing shown in FIG. 3. Conversely, when sander 100 is flexed over a concave surface (e.g., flexed as shown in FIG. 4), the outer ends of sanding surface 114 may be allowed to slide towards the center of base member 106 instead of tearing or pulling loose from the base member (which might occur if the ends were not allowed to slide in relation to the base member). For example, the center points A and A' remain in alignment while points B' on sanding surface 114 move closer to points A/A' (the center of base member 106) during the flexing shown in FIG. 4.

Some embodiments of sander 100 may include use of base member 106 without stabilizing members 118 in the sander. For example, in one embodiment, sander 100, depicted in FIGS. 5 and 6, may be formed without stabilizing members 118 (e.g., components 110 are directly attached to the surfaces of elastomeric body 102 in recessed portions 108). In such an embodiment, the depths of recessed portions 108 may be adjusted to maintain a relatively flat support surface and allow sanding surface 114 to have substantially the same height above base members 106 and components 110 when components 110 are coupled to component 112.

Figure 7:
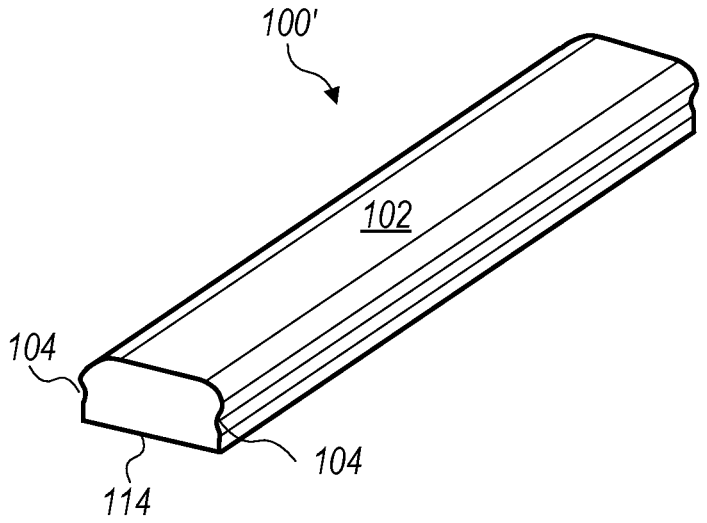
FIG. 7 depicts a perspective view of another embodiment of a sander.
Figure 8:
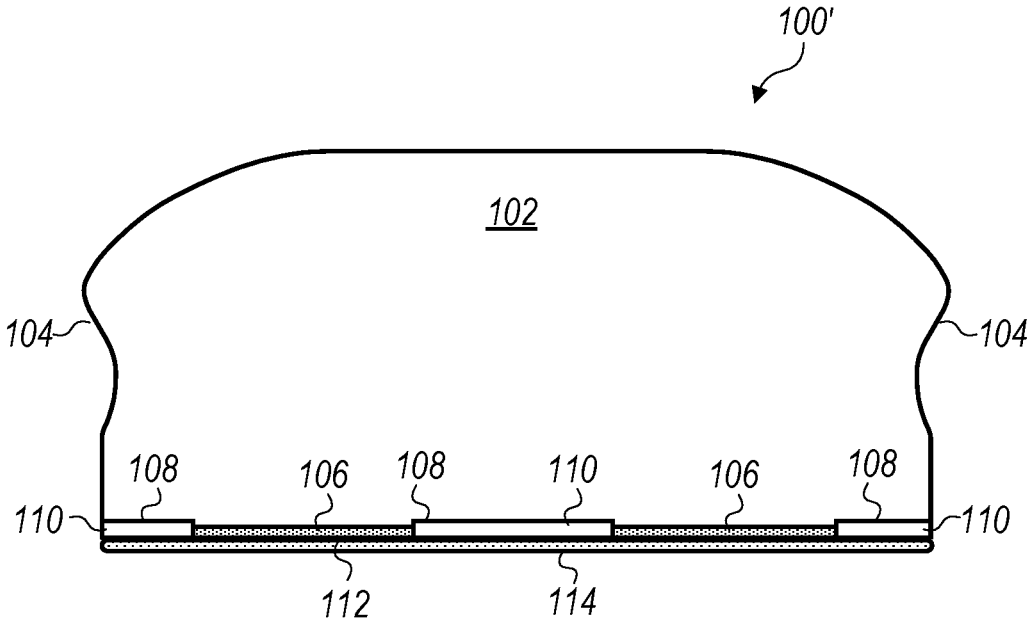
FIG. 8 depicts a cross-sectional end-view representation of the embodiment of the sander depicted in FIG. 7.

Other embodiments of a sander without stabilizing members 118 may, however, also be contemplated. FIG. 7 depicts a perspective view of another embodiment of sander 100'. FIG. 8 depicts a cross-sectional representation of the embodiment of sander 100' depicted in FIG. 7. In certain embodiments of sander 100', one or more base members 106 are attached or bonded to elastomeric body 102. Base members 106 may be attached to the bottom surface (e.g., the flat bottom surface or relatively flat bottom surface) of elastomeric body 102, as shown in FIG. 8. As described above, base members 106 may be elongated thin, relatively flat pieces of strong, flexible material such as, but not limited to, steel (e.g., stainless steel), carbon fiber, or fiberglass. In some embodiments, base members 106 are flat spring members. In certain embodiments, base members 106 have a thickness between about 0.015" and about 0.020". In some embodiments, base members 106 have a thickness between about 0.010" and about 0.040". In certain embodiments, elastomeric body 102 is formed or molded (e.g., using an injection or poured molding process) around base members 106.

In certain embodiments, as shown in FIG. 8, recessed portions 108 are positioned around and/or alongside base members 106 on the flat bottom of elastomeric body 102. In certain embodiments, first hook-and-loop components 110 are positioned in recessed portions 108 on elastomeric body 102. Components 110 may be, for example, hook components of a hook-and-loop fastener (e.g., a Velcro fastener).

Figure 9:
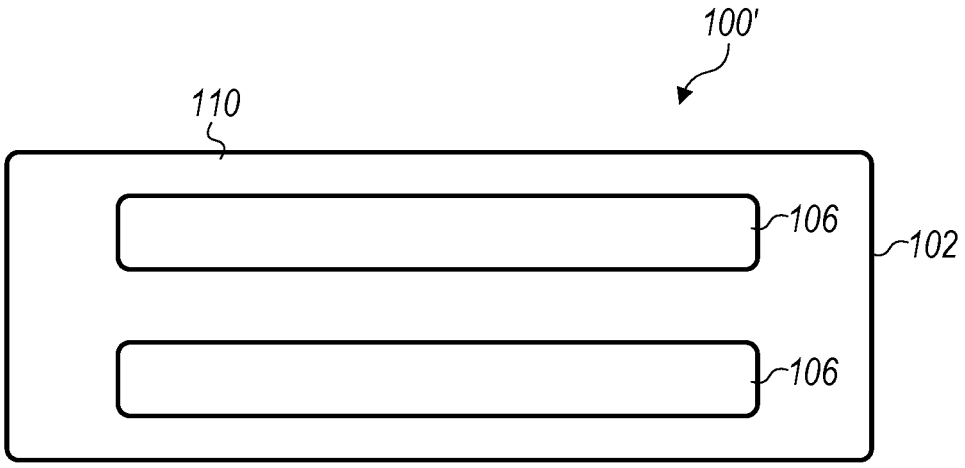
FIG. 9 depicts a bottom-view representation showing relative positions of base members and components in one embodiment of a sander.

FIG. 9 depicts a bottom-view representation showing relative positions of base members 106 and components 110 in one embodiment of sander 100'. In the embodiment depicted in FIG. 9, base members 106 are rectangular-shaped base members surrounded by component 110. In some embodiments, component 110 is a single component attached to elastomeric body 102 and shaped to surround base members 106. In some embodiments, component 110 is made up of several components attached to elastomeric body 102 and positioned to form a single layer around the base members. For example, component 110 may include multiple strips of hook components attached to elastomeric body 102. Component 110 may be attached to elastomeric body 102 using an adhesive. For example, component 110 may include an adhesive surface that attaches the component to elastomeric body 102.

Figure 10:
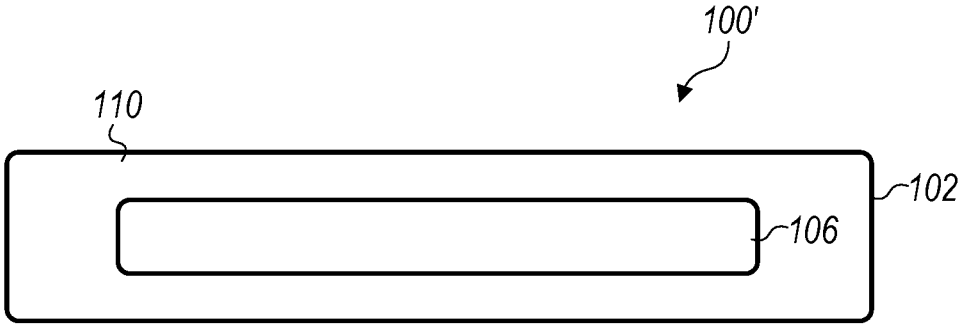
FIG. 10 depicts a bottom-view representation of an embodiment of a sander with a base member being a single strip surrounded by a component.
Figure 11:
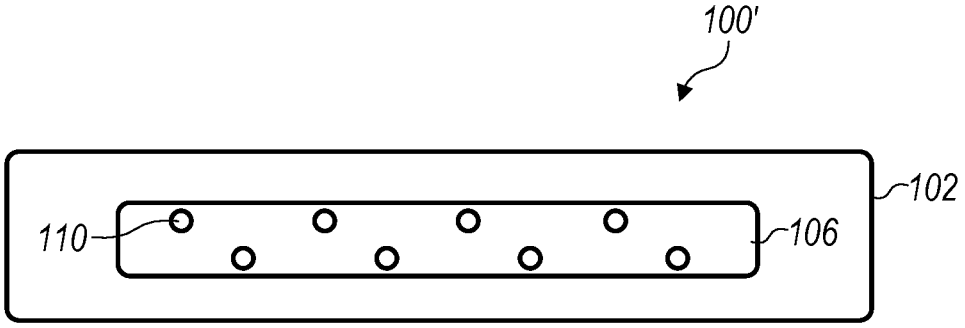
FIG. 11 depicts a bottom-view representation of an embodiment of a sander with a base member having holes.
Figure 12:
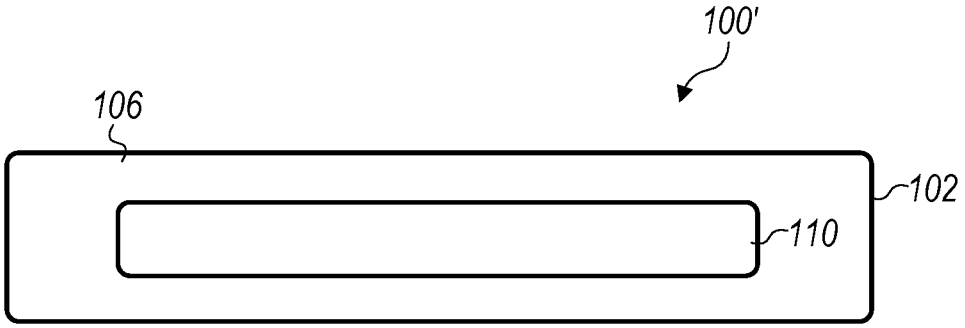
FIG. 12 depicts a bottom-view representation of an embodiment of a sander with a component being a single elongated strip surrounded by a base member.

While FIG. 9 depicts base members 106 as two elongated strips and component 110 surrounding the strips, it is to be understood that base members 106 and components 110 may be arranged in numerous different configurations on the bottom surface of elastomeric body 102 that allow the base members to provide resistance to stretching and compression while components 110 allow for attachment of a sanding surface using a hook-and-loop fastener (as described herein). FIGS. 10-12 depict bottom-view representations showing relative positions of base members 106 and components 110 in alternative embodiments of sander 100'. FIG. 10 depicts a bottom-view representation of an embodiment of sander 100' with base member 106 being a single strip surrounded by component 110. FIG. 11 depicts a bottom-view representation of an embodiment of sander 100' with base member 106 having holes in which components 110 are positioned. FIG. 12 depicts a bottom-view representation of an embodiment of sander 100' with component 110 being a single elongated strip surrounded by base member 106. It should be noted that in each of the embodiments depicted in FIGS. 9-12 and other possible embodiments, base members 106 are attached to the bottom surface of elastomeric body 102 and components 110 are positioned in recessed portions (e.g., recessed portions 108) of the elastomeric body. It may also be contemplated to place stabilizing members 118, as described herein, in one or more of the embodiments depicted in FIGS. 9-12.

In certain embodiments, as shown in FIG. 8, component 112 is coupled to (e.g., attached or fastened to) component(s) 110. As described above, component 112 may be a second hook-and-loop component that is paired with component(s) 110. Attaching component 112 to component(s) 110 may place component 112 close to or in contact with the surface(s) of base member(s) 106. In certain embodiments, as shown in FIG. 8, sanding surface 114 is attached to component 112. Sanding surface 114 may be, as described above, a thin piece of sandpaper or another abrasive material coupled to component 112. Sanding surface 114 may be used to sand the surface of the automobile or another surface while elastomeric body 102 and base members 106 provide support for the sanding surface.

In certain embodiments, as described herein, placing components 110 (e.g., the hook components) in recessed portions 108 of elastomeric body 102 allows component 112 to be adjacent to (e.g., next to) base members 106 rather than being spaced apart from the base members by the thickness of the component 110. Placing components 110 in the recessed portions may allow component 112 and sanding surface 114 to be positioned as close to a centerline of base member 106 as possible. As described herein, the centerline of base member 106 does not change in length when the elastomeric body is flexed. Thus, placing sanding surface 114 close to the centerline of base member 106 may allow the sanding surface to be flexed without the sanding surface buckling or pulling loose from the bottom surface of sander 100 and/or sander 100'. In some embodiments, sanding surface 114 may, using embodiments of sander 100 and sander 100' described herein, be flexed more without buckling or pulling loose than may be possible with other types of flexible sanders that utilize hook-and-loop fasteners because the sanding surface is close to the centerline of base member 106 in sander 100 and/or sander 100'. As such, sander 100 and/or sander 100' may be repeatedly flexed and straightened without tearing or buckling sanding surface 114.

In some embodiments, sander 100 and/or sander 100' can be flexed in a twisting motion without as much buckling or tearing. Twisting sander 100 and/or sander 100' may be useful when working on (e.g., sanding) angled surfaces such as fenders of an automobile. The twisting motion of sander 100 and/or sander 100' may allow the user to track the surfaces of the angled surface more closely by moving the sander at complementary angles. Having sanding surface 114 close to the centerline of base member 106 may allow the sanding surface to be twisted more without buckling or pulling loose of the sanding surface.

In certain embodiments of sander 100' (shown in FIGS. 7-9), depths of recessed portions 108 in the bottom surface of elastomeric body 102 are selected to allow sanding surface 114 to have substantially the same height above base members 106 and components 110 when components 110 are coupled to component 112. For example, portions of sanding surface 114 backed with component 112 over base members 106 may have the same height as portions of sanding surface 114 backed with component 112 over components 110 in the recessed portions when components 110 and component 112 are coupled together. In some embodiments, depths of the recessed portions of elastomeric body 102 are selected to be substantially equivalent to a thickness of components 110 plus the difference in the sum of the thickness of components 110 and component 112 when the components are measured individually minus the thickness of components 110 and component 112 when the components are attached together. As such, when components 110 are placed in the recessed portions and components 110 and component 112 are coupled together, sanding surface 114 may have substantially the same height above the base members 106 and components 110 in the recessed portions after components 110 and component 112 are pressed together. In one embodiment, recessed portions 108 in elastomeric body 102 have a depth of about 0.080" (e.g., a depth suitable for hook side of a hook-and-loop fastener) while sanding surface 114 has a thickness of about 0.022".

Figure 13:
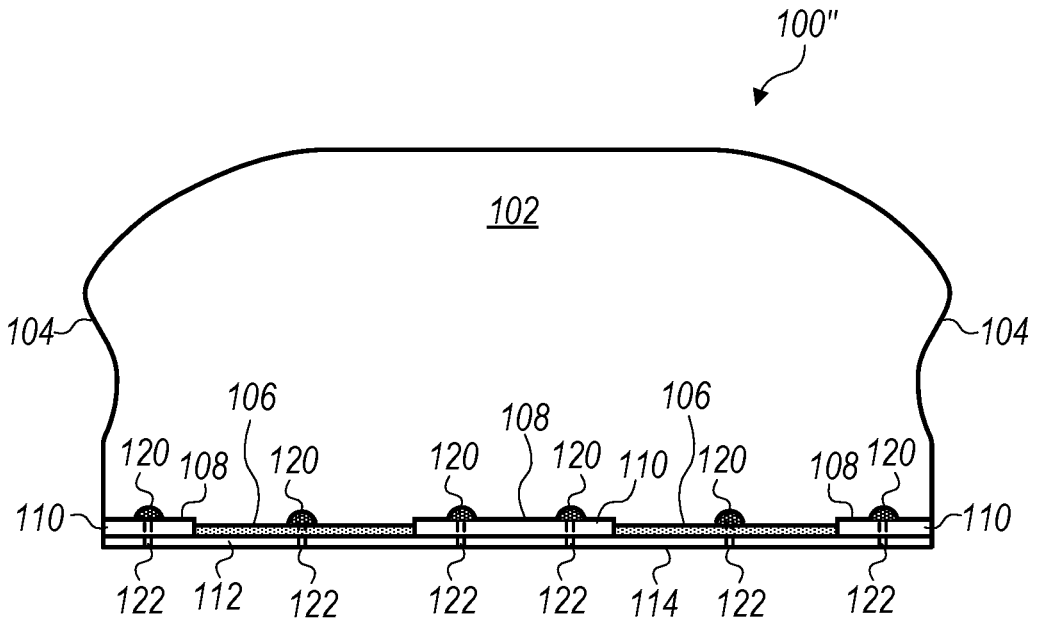
FIG. 13 depicts a cross-sectional end-view representation of yet another embodiment of a sander.

FIG. 13 depicts a cross-sectional representation of another embodiment of sander 100". In the embodiment depicted in FIG. 13, elastomeric body 102 includes one or more passages 120. Passages 120 may be, for example, grooves or channels behind recessed portions 108 and components 110 along a length of elastomeric body 102. In certain embodiments, components 110, component 112, and sanding surface 114 have holes 122 aligned with passages 120. In some embodiments, passages 120 may be positioned to align with preformed holes in sanding surface 114 (holes in components 110 and component 112 may similarly be made to align with preformed holes in the sanding surface). In some embodiments, passages 120 may be behind base members 106 and/or base members 106 may have holes 122 aligned with the passages (and holes in component 112).

In certain embodiments, passages 120 extend to at least one end of elastomeric body 102. In some embodiments, passages 120 connect together at or near the end of elastomeric body 102. At the end of elastomeric body 102, a hose (or another conduit) may be coupled to passages 120. The other end of the hose may be coupled to, for example, a vacuum cleaner or vacuum system. Dust and/or other particles generated by sanding surface 114 during use of sander 100" may then be collected by the vacuum cleaner through passages 120 and holes 122.

Figure 14:
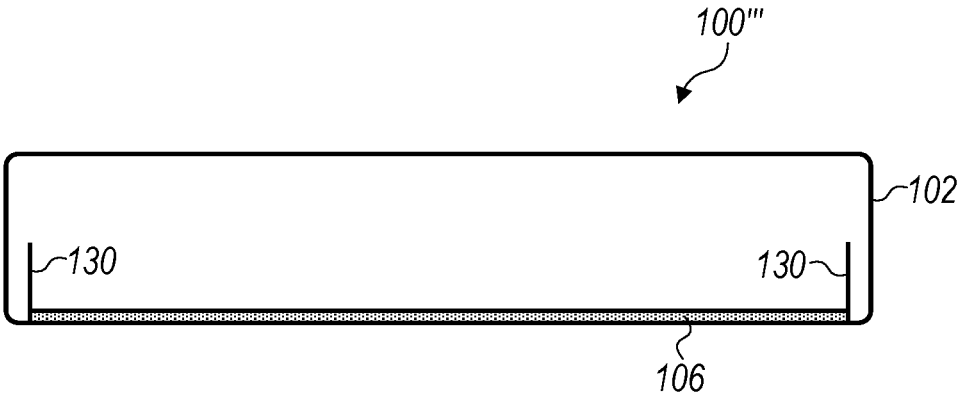
FIG. 14 depicts a cross-sectional side-view representation of an embodiment of a sander with blocks attached to base members.

FIG. 14 depicts a cross-sectional side-view representation of an embodiment of sander 100' with blocks 130 attached to ends of base member 106. Blocks 130 may be perpendicular blocks or angles attached to (e.g., bonded to) the ends of base member 106. For embodiments with multiple base members 106 in sander 100''', blocks 130 may be attached to the ends of each base member. In some embodiments, blocks 130 are attached to the ends of base member 106 to handle the load caused by the stretching or compressing of elastomeric body 102 and may relieve the shear stress of the bond between the elastomeric body and the base member. Relieving the shear stress may allow the bond between elastomeric body 102 and base member 106 to remain intact for longer length embodiments of sander 100'''. When sander 100' is in the flat position, there may be little to no stress on the bond; however, as the sander bends, the shear stress increases as the distance increases from the middle of the sander toward each end. Thus, for longer length embodiments of sander 100''', stress relief using blocks 130 may become more necessary to relieve shear stress of the bond between elastomeric body 102 and base member 106. The blocks 130 may also be added to stabilizing member(s) 118 in embodiments of a sander with stabilizing members.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. A sanding apparatus, comprising:

an elastomeric body having a bottom surface;

at least one thin, relatively flat spring member attached to the bottom surface of the elastomeric body; and at least one first component of a hook-and-loop fastener coupled to the bottom surface of the elastomeric body, wherein the at least one first component of the hook-and-loop fastener is positioned in a recess on the bottom surface of the elastomeric body;

wherein the at least one thin, relatively flat spring member and the at least one first component of the hook-and-loop fastener are positioned such that the outer surface of each is in approximately the same plane to form a relatively flat surface on the bottom surface of the elastomeric body for at least one second component of the hook-and-loop fastener to attach thereto.

2. The apparatus of claim 1, wherein a sanding surface is configured to be attached to the at least one second component of the hook-and-loop fastener.

3. The apparatus of claim 2, wherein the sanding surface has a relatively flat profile when attached to the at least one second component of the hook-and-loop fastener.

4. The apparatus of claim 2, wherein the at least one second component of the hook-and-loop fastener is configured to be attached to the at least one first component of the hook-and-loop fastener with at least some portion of the at least one second component and the sanding surface being positioned over at least some portion of the at least one thin, relatively flat spring member.

5. The apparatus of claim 4, wherein the sanding surface has substantially the same height above the at least one thin, relatively flat spring member and the at least one first component of the hook-and-loop fastener.

6. The apparatus of claim 5, wherein a depth of the recess on the bottom surface of the elastomeric body is selected to allow the sanding surface to have substantially the same height above the at least one thin, relatively flat spring member and the at least one first component of the hook-and-loop fastener.

7. The apparatus of claim 5, wherein a depth of the recess on the bottom surface of the elastomeric body is selected to be substantially equivalent to a thickness of the first component of the hook-and-loop fastener plus the difference in the sum of the thickness of the first and second components of the hook-and-loop fastener when the components are measured individually minus the thickness of the first and second components when the components are attached together.

8. The apparatus of claim 1, further comprising at least one additional thin, relatively flat spring member attached to the bottom surface of the elastomeric body in the recess on the bottom surface, wherein the at least one first component of a hook-and-loop fastener is attached to the additional flat spring member in the recess.

9. The apparatus of claim 1, wherein the flat spring member is an elongated member.

10. The apparatus of claim 1, wherein the flat spring member is metal, fiberglass, carbon fiber, or combinations thereof.

11. The apparatus of claim 1, wherein the elastomeric body comprises a flexible urethane or urethane foam block.

12. The apparatus of claim 1, wherein the first component comprises a hook component of the hook-and-loop fastener.

13. The apparatus of claim 1, wherein the second component comprises a loop component of the hook-and-loop fastener.

14. The apparatus of claim 1, further comprising at least one vacuum passage in the elastomeric body positioned at the recess on the bottom surface of the elastomeric body.

15. The apparatus of claim 1, wherein the flat spring member and the first component are elongated members positioned adjacent to each other.

16. The apparatus of claim 1, wherein the flat spring member comprises one or more holes, and wherein the first component is positioned in the one or more holes in the flat spring member.

17. The apparatus of claim 16, wherein the recess on the bottom surface of the elastomeric body is positioned at the one or more holes in the flat spring member.

18. The apparatus of claim 1, wherein the at least one thin, relatively flat spring member and the at least one first component of the hook-and-loop fastener are positioned adjacent to each other on the bottom surface of the elastomeric body.

19. A sanding apparatus, comprising:

an elastomeric body having a bottom surface;

a first thin, relatively flat spring member attached to the bottom surface of the elastomeric body;

a second thin, relatively flat spring member positioned in a recess on the bottom surface of the elastomeric body and attached to the bottom surface of the elastomeric body in the recess; and at least one first component of a hook-and-loop fastener attached to the second flat spring member in the recess;

wherein the first thin, relatively flat spring member and the at least one first component of the hook-and-loop fastener are positioned such that the outer surface of each is in approximately the same plane to form a relatively flat surface on the bottom surface of the elastomeric body for at least one second component of the hook-and-loop fastener to attach thereto.

20. The apparatus of claim 19, wherein a sanding surface is configured to be attached to the at least one second component of the hook-and-loop fastener.

* * * * *